United States Patent [19]

Kull

[11] 4,327,262

[45] Apr. 27, 1982

[54] GAS-BLAST SWITCH

[75] Inventor: Peter Kull, Schafisheim, Switzerland

[73] Assignee: Sprecher & Schuh AG, Aarau, Switzerland

[21] Appl. No.: 114,230

[22] Filed: Jan. 21, 1980

[30] Foreign Application Priority Data

Feb. 13, 1979 [CH] Switzerland ..... 1395/79

[51] Int. Cl.[3] ..... H01H 33/88

[52] U.S. Cl. ..... 200/148 A

[58] Field of Search ..... 200/148 A

[56] References Cited

U.S. PATENT DOCUMENTS 3,941,962 3/1976 Thaler ..... 200/148 A 4,046,979 9/1977 Hertz et al. ..... 200/148 A

*Primary Examiner*—Robert S. Macon

*Attorney, Agent, or Firm*—Werner W. Kleeman

[57] ABSTRACT

A gas-blast switch containing both a stationary and a movable contact element. At one of these contact elements there is arranged a blast nozzle whose inlet chamber or compartment is connected with the outlet of a pump chamber containing an extinguishing gas and which can be placed under pressure during the cutoff stroke. Between the inlet chamber of the blast nozzle and the pump chamber there is a valve arrangement which is pre-biased in the closing direction. The valve arrangement responds when there is an excess pressure in the pump chamber and opens in the direction of the inlet chamber or compartment. To prevent escape of the extinguishing gas heated by the arc at the region of the blast nozzle, and thus, placed under pressure, and therefore, to also reduce the mechanical and thermal loading of the blast nozzle, the valve arrangement comprises a switching valve which, in the rest position, connects at least part of the inlet chamber of the blast nozzle with the space or chamber surrounding such blast nozzle and upon response of such switching valve disconnects the aforesaid part of the inlet chamber from the space surrounding the inlet chamber of the blast nozzle.

8 Claims, 1 Drawing Figure

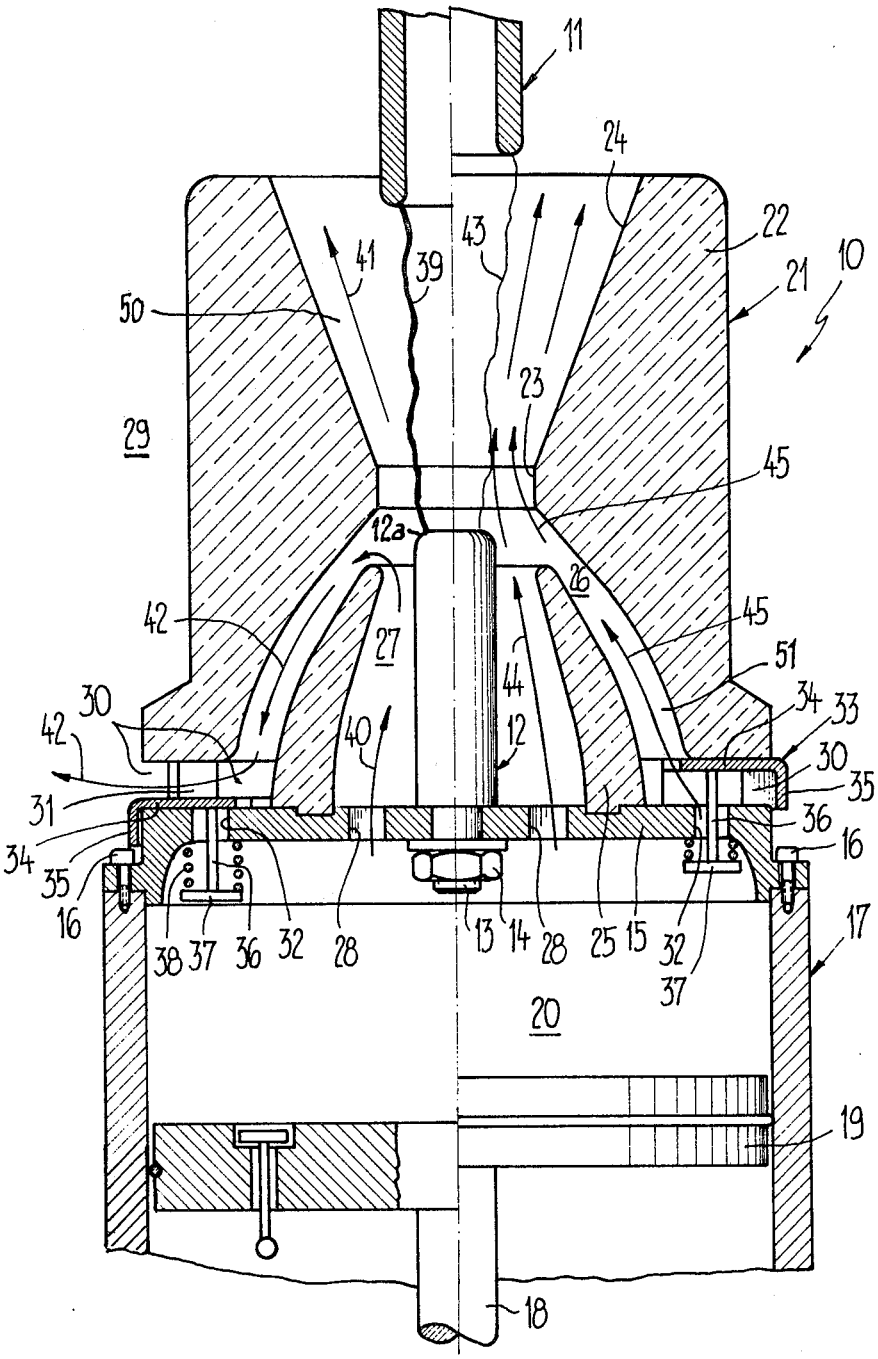
11
24
22
10
21
41
39
43
50
23
29
45
12a
26
42
27
45
51
44
34
33
30
42
40
12
30
35
31
36
34
16
35
16
38
37
36
32
28
13
14
28
25
15
32
37
17
20
19
18

GAS-BLAST SWITCH

BACKGROUND OF THE INVENTION

The present invention relates to a new and improved construction of gas-blast switch.

Generally speaking, the gas-blast switch of the present development is of the type comprising both a fixed contact element and a movable contact element. A blast nozzle is operatively associated with one of the contact elements, the blast nozzle having an inlet which can be connected with the outlet of a pump chamber. This pump chamber contains an extinguishing gas and is pressurized during the course of a cutoff stroke of the gas-blast switch. The narrowest location or throat of the blast nozzle is arranged downstream of the end of the related contact element. Between the inlet of the blast nozzle and the pump chamber there is provided a valve arrangement. This valve arrangement is pre-biased in the closing direction, responds to excess pressure conditions prevailing in the pump chamber and opens in the direction of the inlet.

Such type gas-blast switches are known, for instance, from German Pat. No. 2,316,009, corresponding essentially to Swiss Pat. No. 573,171, or from German Patent Publication No. 2,411,897. With the heretofore known gas-blast switches of this type the valve arrangement merely consists of a pre-biased check valve. This check valve is assigned the task of suppressing the connection between the pump chamber and the inlet chamber of the blast nozzle as soon as the pressure, emanating from the extinguishing gas in the blast nozzle which is heated by the arc, exceeds the momentary pressure prevailing in the pump chamber, to thereby prevent any return flow of this heated gas back to the pump chamber. With the state-of-the-art gas-blast switches the blast nozzle itself therefore must be capable of withstanding such pressure surge, and those heated gases located between the throat of the blast nozzle and the end of the related contact element appreciably render more difficult the outflow through the nozzle throat. Therefore, with the heretofore known gas-blast switches there is formed a thermal and a pressure bridge or dam at the inlet chamber of the blast nozzle, which has the result that the blast nozzle is exposed to burn-off phenomenon and appreciable mechanical loads, and therefore must be appropriately dimensioned and designed.

SUMMARY OF THE INVENTION

Hence, with the foregoing in mind it is a primary object of the present invention to provide a new and improved construction of gas-blast switch which is not associated with the aforementioned drawbacks and limitations of the prior art constructions.

Another and more specific object of the present invention aims at providing a new and improved construction of gas-blast switch of the previously mentioned type which faultlessly enables a rapid outflow of the gases heated by the arc even at the inlet of the blast nozzle, and there is still prevented, as previously also was the case, any penetration of such gas into the pump chamber.

Yet a further significant object of the present invention aims at the provision of a new and improved construction of gas-blast switch which is relatively simple in design, economical to manufacture, extremely reliable in operation, particularly provides for positive cutoff operation, and effectively overcomes the aforementioned shortcomings of the prior art gas-blast switches discussed above.

Now in order to implement these and still further objects of the invention, which will become more readily apparent as the description proceeds, the gas-blast switch of the present development is manifested by the features that the valve arrangement comprises at least one switching valve which, in its rest position, flow communicates the inlet of the blast nozzle with the space surrounding the blast nozzle. Upon response of such switching valve it separates the inlet of the blast nozzle from the chamber or space surrounding the same.

BRIEF DESCRIPTION OF THE DRAWINGS

The invention will be better understood and objects other than those set forth above will become apparent when consideration is given to the following detailed description thereof. Such description makes reference to the annexed drawing wherein the single FIGURE schematically illustrates in longitudinal sectional view the essential parts of a gas-blast switch according to the invention, the left-hand portion of the illustration showing the parts of the gas-blast switch in their position with a very intensely burning arc, while the right-hand portion of the gas-blast switch illustrates the arc shortly prior to the current null throughpass, in other words prior to extinguishing of the arc.

DETAILED DESCRIPTION OF THE PREFERRED EMBODIMENTS

Describing now the drawing, it is to be understood that only enough of the structure of the gas-blast switch has been shown in the single FIGURE of the drawing in order to simplify the illustration, while enabling one skilled in the art to readily understand the underlying principles and concepts of the inventive development. Turning attention now to the drawing, the illustrated exemplary embodiment of gas-blast switch 10 will be seen to contain at its top end a substantially tubular-shaped fixed contact element 11 which, in the cuton position, engages at its inner diameter or surface the outer diameter or surface of a movable contact element 12. The movable contact element 12 is fixedly anchored at a metallic closure flange 15, by means of any suitable fastening arrangement, for instance here shown constituted by a threaded bolt 13 and a nut member 14. This closure flange 15 is attached, in turn, by means of the threaded bolts 16 at the end of a metallic pump cylinder 17 which, thus, also assumes the task of infeeding the current. The pump cylinder or chamber 17 is coupled at its not particularly illustrated lower end with a likewise not shown drive of conventional design, by means of which the pump cylinder 17 can be displaced up and down, and therefore, the movable contact element 12 can also be brought into and out of engagement with the fixed contact element 11. The pump cylinder 17 is displaceable upon a stationarily supported pump piston 19 by means of a piston rod 18 formed of any suitable insulating material. Between the pump piston 19 and the closure flange 15 the pump cylinder 17 therefore encloses a pump chamber or compartment 20, the volume of which reduces during the course of a cutoff stroke, i.e. during downward movement of the pump cylinder 17.

At the side facing away from the pump chamber 20 there is secured to the closure flange 15 a blast nozzle 21 formed of an arc-resistant, electrically insulating material. The space or compartment 50 enclosed by the nozzle body 22 of the blast nozzle 21 comprises an inlet chamber 51, a narrow or constrictive location or throat 23 and an outlet chamber 24 having a throughflow cross-section which enlarges in a direction away from the throat 23. The throat 23 of the blast nozzle 21 is arranged forwardly of the free end 12*a* of the related movable contact element 12 in the direction of the fixed or stationary contact element 11 which, in turn, in the cuton position, bears with its outer surface or diameter practically sealingly at the throat 23. The aforementioned inlet chamber 51 of the blast nozzle 21 is subdivided into an outer jacket chamber 26 and an inner jacket chamber 27 by means of a partition or separation body 25. This partition body or element 25 is likewise fixedly anchored at the closure flange 15 and is formed of the same material as the nozzle body 22. Both of the jacket chambers or spaces 26 and 27 converge in the direction of the nozzle throat 23.

The inner jacket chamber 27 is in continuous flow communication with the pump chamber 20 by means of the passageways or throughpassages 28 provided at the closure flange 15. At the region of the attachment location at the closure flange 15 there are formed in the nozzle body 22 passages or passageways 30 which lead radially into the chamber or space 29 surrounding the blast nozzle 21. These radial passages 30 are in the form of circumferential slots separated from one another by support webs 31. Additionally, further passages 32 are formed at the closure flange 15. Operatively associated with the passages or passageways 30 and 32 is a valve body 33 possessing an essentially L-shaped configuration in cross-section. This valve body 33 can assume two positions. In the first position, the so-called rest position, as shown at the left of the drawing, the one leg 34 of the valve body 33 closes the related passage 32, whereas the other leg 35 frees the related passage 30. In this rest position the outer jacket space or chamber 26 of the inlet chamber 51 of the blast nozzle 21 is in flow communication with the surrounding chamber or space 29. On the other hand, in the other valve position, the so-called work position, as shown at the right of the drawing, the leg 34 frees the related passage 32, whereas the leg 35 closes the passage 30. Hence, in this position the outer jacket chamber or space 26 flow communicates by means of the passages 32 with the pump chamber 20, not however with the space 29. The valve body 33 thus forms in conjunction with the passageways or passages 30 and 32 a switching valve which connects the outer jacket chamber 26 either with the pump chamber 20 or with the chamber or space 29 surrounding the blast nozzle 21.

The valve body 33 is attached to a shaft 36 which piercingly extends through the related passage 32. At the shaft 36 there is attached a plate 37. Between the plate 37 and the side of the closure flange 15 which confronts the pump chamber 20 there is spanned a compression or pressure spring 38. This pressure spring 38 strives to retain the valve body 33 in the position shown at the left-hand side of the drawing, as long as there does not exist any excessive overpressure in the pump chamber 20 in relation to the pressure in the outer jacket chamber or space 26.

It should of course be understood that the described parts of the switch are enclosed by a not particularly illustrated, encapsulated housing which, in turn, is completely filled with a suitable extinguishing gas, typically for instance $SF_6$.

During a cutoff stroke there occurs essentially the following operations between both of the contact elements 11 and 12. During the downward stroke of the contact element 12 the extinguishing gas within the pump chamber 20 is compressed and at the same time an arc is ignited between the contact elements 11 and 12. Initially, this arc is quite intensive, as the same has been schematically indicated by reference character 39 at the left-hand side of the drawing. This arc, as soon as the contact element 11 has freed the nozzle throat 23, is blown by the extinguishing gas, schematically indicated by reference character 40, at the region of the nozzle throat 23 and which flows out of the pump chamber 20 through the passages 28 and the inner jacket space or chamber 27, and at that location this gas is intensively heated. In this connection it is to be remarked that the passages 28 themselves have too small a throughflow cross-sectional area, in order to pass the entire feed capacity from the pump chamber 20, so that the pressure in the pump chamber 20 continues to increase. During such time as the extinguishing gas is heated it also experiences an increase in pressure, and therefore, the heated gases must be withdrawn as rapidly as possible. The part of the highly stressed gas, which has already passed the nozzle throat 23, escapes out of the b1ast nozzle 21 through the outlet chamber or space 24, in the direction of the arrow 41, whereas the remainder of the gas can escape, in the direction of the arrow 42, through the outer jacket space or chamber 26 and the passages 30 into the chamber 29, because the pressure in the pump chamber 20 initially is not yet adequate in order to overcome the force of the spring 38. During the further course of the cutoff stroke of the gas-blast switch, shown in the right-hand portion of the drawing, the arc is further drawn in its length and eventually there is present a current null throughpass. The intensity of the arc therefore decreases, as such has been indicated at the right-hand portion of the drawing by reference character 43. Blowing of the arc by the extinguishing gas inflowing to the inner jacket space or chamber 27 continues, as has been schematically indicated by the arrow 44. On the other hand, the pressure in the pump chamber 20 has increased in the meantime to such a degree that the valve body 33 is raised out of its rest position. Consequently, fresh extinguishing gas now also flows through the passages 32 and through the outer jacket chamber 26, as indicated by the arrow 45, to the nozzle throat 23, and blowing of the arc 43 is further intensified until the arc is extinguished. In any event there is available for the extinguishing gases, at the moment that they are intensively heated, more space for escaping than is the case with the prior art comparable gas-blast switches, so that also there is decisively reduced the mechanical and thermal loading of the nozzle body 22.

While with the described exemplary embodiment of gas-blast switch the valve body 33 is designed so as to be displaceable linearly and essentially parallel to the switching stroke, it should of course be understood that the valve body also can be constituted by a flap member or equivalent structure which is hingedly connected at the periphery of the closure flange 15 and is resiliently pre-biased towards the passages 32, this flap member being upwardly pivoted or rocked when there is adequate excess pressure in the pump chamber 20, and thus, blocks the passages 30 while freeing the passages 32.

While there are shown and described present preferred embodiments of the invention, it is to be distinctly understood that the invention is not limited thereto, but may be otherwise variously embodied and practised within the scope of the following claims. ACCORDINGLY,

What I claim is:

1. A gas-blast switch comprising:

a fixed contact element;

a movable contact element cooperating with said fixed contact element;

a blast nozzle operatively associated with one of the contact elements;

means defining a pump chamber containing an extinguishing gas which can be placed under pressure during the course of a cutoff stroke of the gas-blast switch;

said pump chamber having an outlet;

said blast nozzle having an inlet connected with the outlet of the pump chamber;

said blast nozzle having a nozzle throat arranged downstream with respect to the flow direction of the extinguishing gas from an end of the related contact element;

a valve arrangement disposed between the inlet of the blast nozzle and the pump chamber;

said valve arrangement being pre-biased in its closing direction and responding to excess pressure prevailing in the pump chamber and opening in the direction of the inlet;

said valve arrangement comprising at least one switching valve movable between a rest position and a work position;

means for biasing said switching valve into its rest position;

said switching valve, when in said rest position, flow communicating the inlet of the blast nozzle with a space surrounding said blast nozzle and disconnecting the inlet of the blast nozzle from the pump chamber; and said switching valve being movable into its work position in response to excess pressure prevailing in the pump chamber; and said switching valve, when in said work position, flow communicating the pump chamber with the inlet of the blast nozzle and disconnecting the blast nozzle from the surrounding space.

2. The gas-blast switch as defined in claim 1, wherein:

said blast nozzle has an inlet compartment;

a partition body for subdividing the inlet compartment of the blast nozzle into an outer jacket chamber and an inner jacket chamber;

both of the jacket chambers being connected with the pump chamber;

said switching valve being arranged between the pump chamber and the outer jacket chamber; and valveless passage means for connecting the inner jacket chamber with the pump chamber.

3. The gas-blast switch as defined in claim 2, wherein:

said switching valve comprises a valve body;

continuous essentially radially outwardly extending passageways provided at the region of the inlet of the blast nozzle; and said passageways being covered by the valve body upon response of the switching valve.

4. The gas-blast switch as defined in claim 3, wherein:

said valve body, upon response of the switching valve, covers a radial outer side of the passageways.

5. The gas-blast switch as defined in claim 3, wherein:

said valve body possesses an essentially L-shaped cross-section configuration and is constituted by two leg members;

wherein the one leg member coacts with the radially outwardly extending passageways of the blast nozzle; and the other leg member coacting with passages leading out of the pump chamber to the outer jacket chamber.

6. The gas-blast switch as defined in claim 5, further including:

spring means acting upon said valve body; and said valve body being displaceably arranged essentially parallel to the switching stroke against the action of the spring means.

7. The gas-blast switch as defined in claim 1, wherein:

said switching valve comprises a valve body;

continuous essentially radially outwardly extending passageways provided at the region of the inlet of the blast nozzle; and said passageways being covered by the valve body upon response of the switching valve.

8. The gas-blast switch as defined in claim 7, wherein:

said valve body, upon response of the switching valve, covers a radial outer side of the passageways.

* * * * *